US011047121B2

(12) United States Patent
Ukigai et al.

(10) Patent No.: US 11,047,121 B2
(45) Date of Patent: Jun. 29, 2021

(54) TOILET SPACE DEODORIZING DEVICE AND SANITARY WASHING DEVICE

(71) Applicant: TOTO LTD., Kitakyushu (JP)

(72) Inventors: Kiyotake Ukigai, Kitakyushu (JP); Yuya Otowa, Kitakyushu (JP); Shoko Uemoto, Kitakyushu (JP); Shunichi Nakamichi, Kitakyushu (JP); Kanako Isono, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 16/545,124

(22) Filed: Aug. 20, 2019

(65) Prior Publication Data

US 2020/0063421 A1 Feb. 27, 2020

(30) Foreign Application Priority Data

Aug. 21, 2018 (JP) ..... JP2018-154841
Aug. 21, 2018 (JP) ..... JP2018-154842

(51) Int. Cl.
*E03D 9/00* (2006.01)

(52) U.S. Cl.
CPC ..... *E03D 9/00* (2013.01)

(58) Field of Classification Search
CPC ..... E03D 9/052; E03D 9/00
USPC ..... 4/209 R, 216
See application file for complete search history.

(56) References Cited

U.S. PATENT DOCUMENTS

2006/0064805 A1* 3/2006 Yamamoto ..... E03D 9/05 4/213

FOREIGN PATENT DOCUMENTS

JP H4-117074 U 10/1992
JP 2017-223030 A 12/2017

* cited by examiner

*Primary Examiner* — Christine J Skubinna
(74) *Attorney, Agent, or Firm* — White & Case LLP

(57) ABSTRACT

A toilet space deodorizing device includes an intake port part forming an intake port, an exhaust port part forming an exhaust port, a fan device, a water collecting part provided inside a deodorizing air channel, a water supply part supplying water to the water collecting part, a drainage part forming a drainage port, a negative pressure generation device forming a negative pressure in the water collecting part, and a controller controlling a driving of the negative pressure generation device. The controller dries the negative pressure generation device to generate a negative pressure. The water supplied from the water supply part is collected in the water collecting part due to air flowing into the water collecting part and pushing on the water supplied from the water supply part by the negative pressure.

14 Claims, 7 Drawing Sheets

TOILET SPACE DEODORIZING DEVICE AND SANITARY WASHING DEVICE

CROSS-REFERENCE TO RELATED APPLICATIONS

This application is based upon and claims the benefit of priority from Japanese Patent Application No. 2018-154841, filed on Aug. 21, 2018 and Japanese Patent Application No. 2018-154842, filed on Aug. 21, 2018; the entire contents of which are incorporated herein by reference.

FIELD

The present invention relates to a toilet space deodorizing device and a sanitary washing device.

BACKGROUND

Various toilet space deodorizing devices that deodorize a toilet space are known. It is known that the offensive-odor components included in the air of the toilet space include highly water-soluble components; and a toilet space deodorizing device has been proposed in which the offensive-odor components included in the air are dissolved in water by causing the air to contact the water.

For example, there is a device that includes a water spraying device that is provided in a warm-water washing toilet seat and sprays water into suctioned air (e.g., Japanese Patent Application Publication No. 2017-223030). The water spraying device includes a water storage part storing water and a vibrator disposed at the bottom part of the water storage part; or the water spraying device is a nozzle spraying water in a mist-like form.

Another device of this type of deodorizing device introduces suctioned air into stored water stored inside a deodorizing chamber (e.g., Japanese Utility Model Application Publication No. Hei 4-117074).

SUMMARY

In an embodiment such as that of Japanese Patent Application Publication No. 2017-223030, a vibrator or a nozzle is necessary; and the deodorizing device may become large and complex due to the vibrator itself, the nozzle itself, the mechanism for operating the vibrator or the nozzle, etc. In an embodiment in which the air is introduced to water such as Japanese Utility Model Application Publication No. Hei 4-117074, the deodorizing device may become large because a large suction device normally is necessary to provide a relatively strong suction force. The larger size and the higher complexity described above can be avoided by not including such a configuration having the larger size or the higher complexity, but the deodorizing performance may degrade.

A toilet space deodorizing device according to an aspect of the invention includes an intake port part forming an intake port; an exhaust port part forming an exhaust port; a fan device intaking air through the intake port; a water collecting part provided inside a deodorizing air channel, the deodorizing air channel linking the intake port and the exhaust port and allowing the air to flow, the water collecting part being configured to collect water inside the deodorizing air channel; a water supply part supplying water to the water collecting part; a drainage part forming a drainage port draining water from the water collecting part; a negative pressure generation device forming a negative pressure in the water collecting part; and a controller controlling a driving of the negative pressure generation device. The controller drives the negative pressure generation device to generate a negative pressure. And the water supplied from the water supply part is collected in the water collecting part due to air flowing into the water collecting part and pressing on the water supplied from the water supply part by the negative pressure.

DETAILED DESCRIPTION OF EMBODIMENTS

Figure 1:
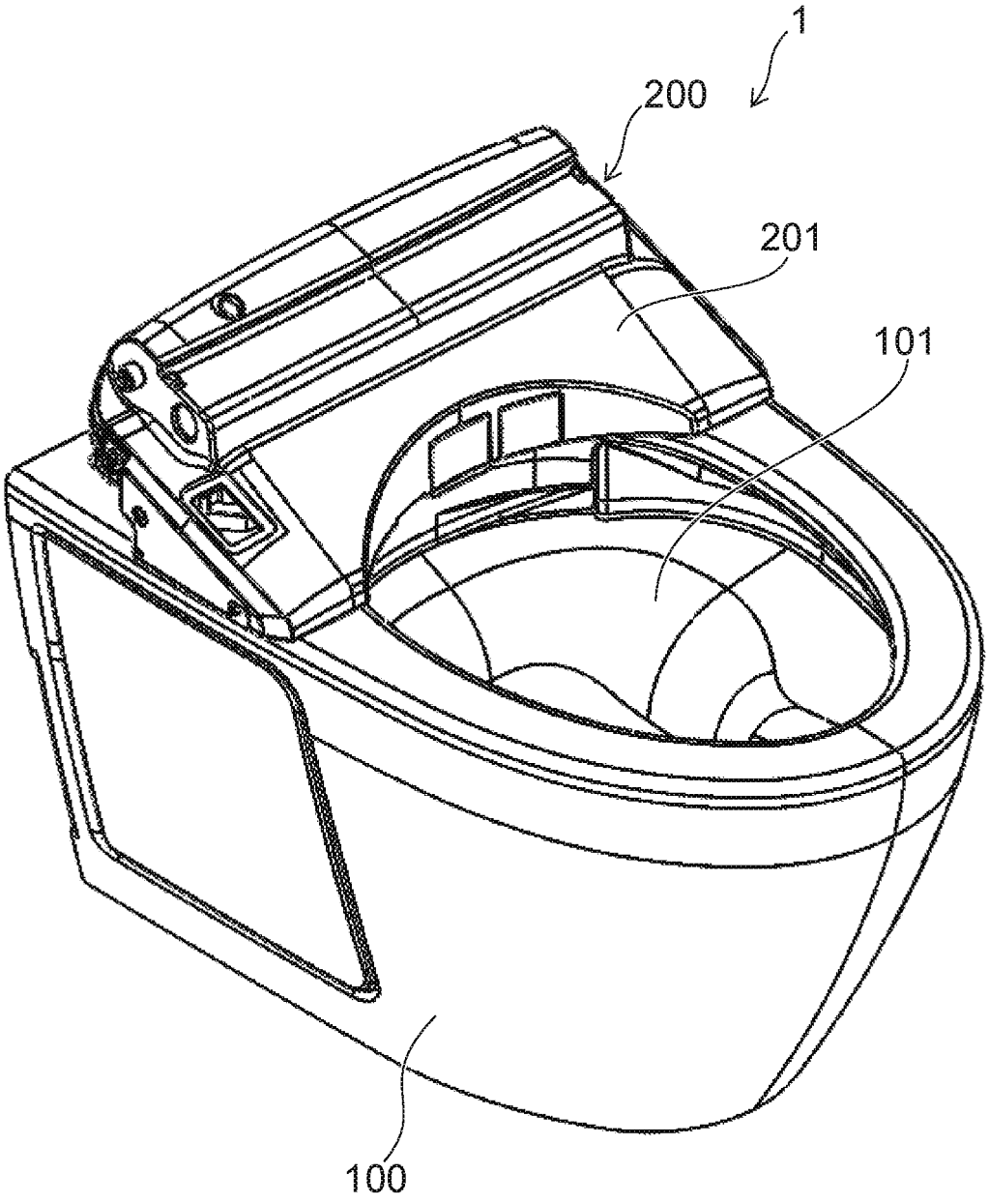
FIG. 1 is an exterior perspective view of a toilet device according to one embodiment.

One of the embodiments of the invention will now be described with reference to the accompanying drawings. For easier understanding of the description, the same components in the drawings are marked with the same reference numerals when possible; and duplicate descriptions are omitted.

FIG. 1 is an exterior perspective view of a toilet device 1 according to one embodiment.

As shown in FIG. 1, the toilet device 1 that is mounted in a toilet space includes a sit-down flush toilet (hereinbelow, called simply the toilet) 100, and a sanitary washing device 200 mounted on the toilet 100. The toilet 100 includes a bowl part 101 open upward in which water stores. By a user operating an operation part (not illustrated), the bowl part 101 is washed by washing water and drains the washing water through a drainage pipe (not illustrated). The sanitary washing device 200 includes a private part washing functional part that washes a private part such as the bottom or the like of the user sitting on the toilet 100 with a toilet seat (not illustrated) interposed, etc. The sanitary washing device 200 also includes a toilet space deodorizing device (hereinbelow, called simply the deodorizing device) 10.

Figure 2:
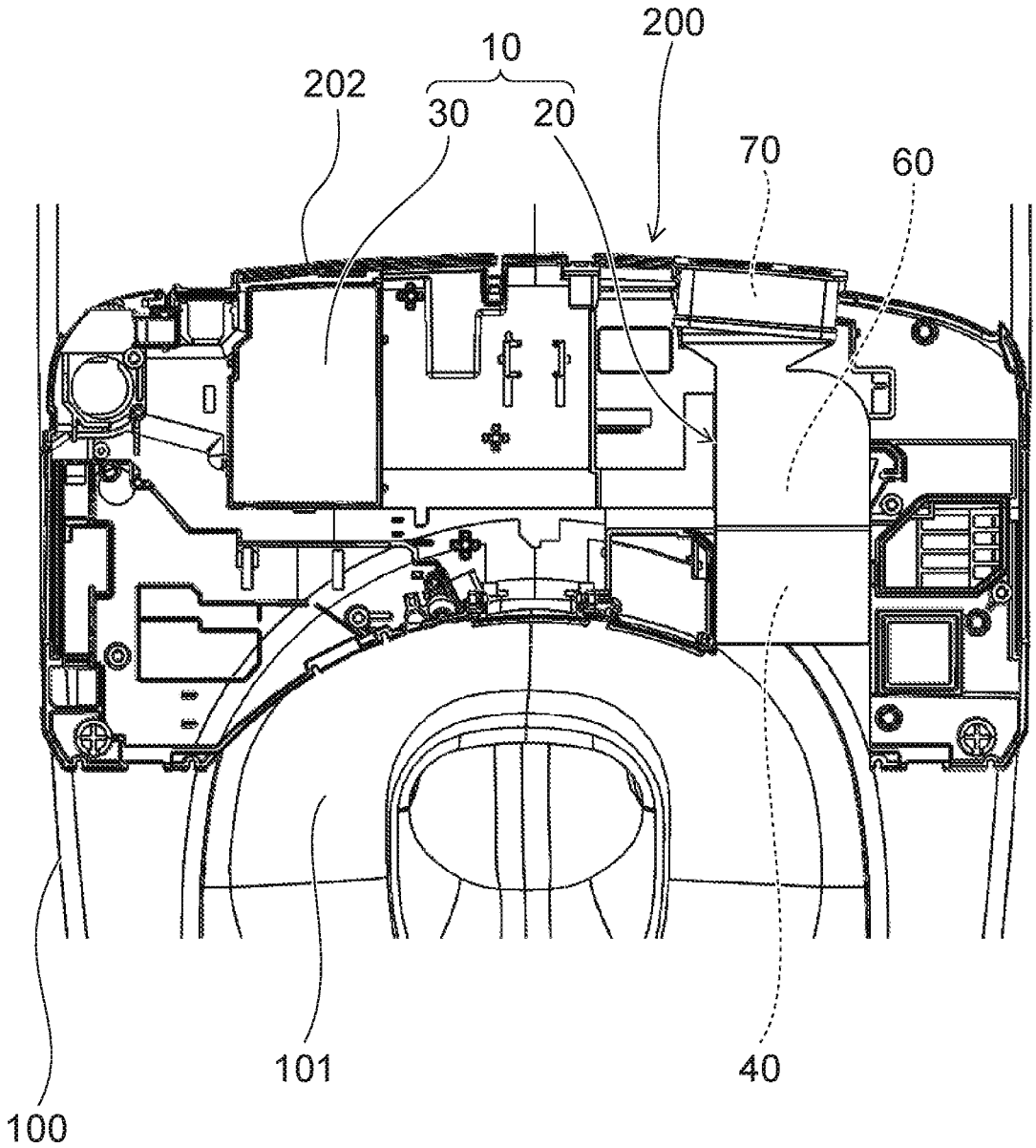
FIG. 2 is a plan view of a toilet space deodorizing device according to one embodiment.

FIG. 2 is a plan view of the deodorizing device 10 according to the embodiment, and illustrates a state in which a cover 201 of the sanitary washing device 200 of FIG. 1 is removed. The nozzle and the like that are included in the private part washing functional part are not illustrated in FIG. 2.

As shown in FIG. 2, the deodorizing device 10 includes a water deodorizing unit 20 and a controller 30.

Figure 3:
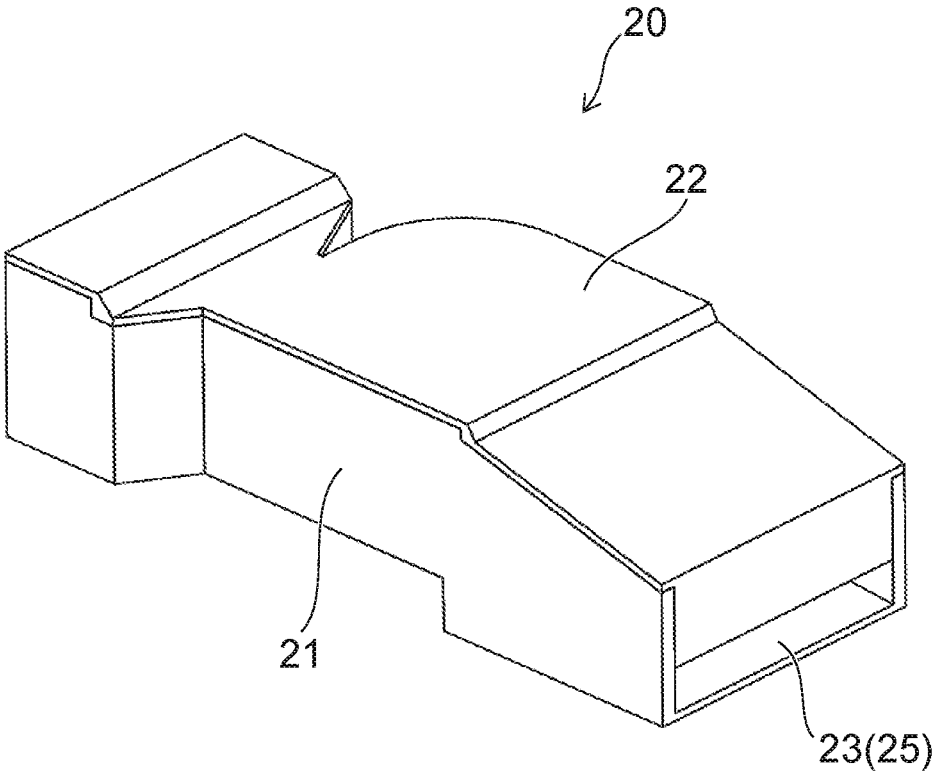
FIG. 3 is a perspective view of a water deodorizing unit of the toilet space deodorizing device according to one embodiment.

FIG. 3 is a perspective view of the water deodorizing unit 20.

Figure 4:
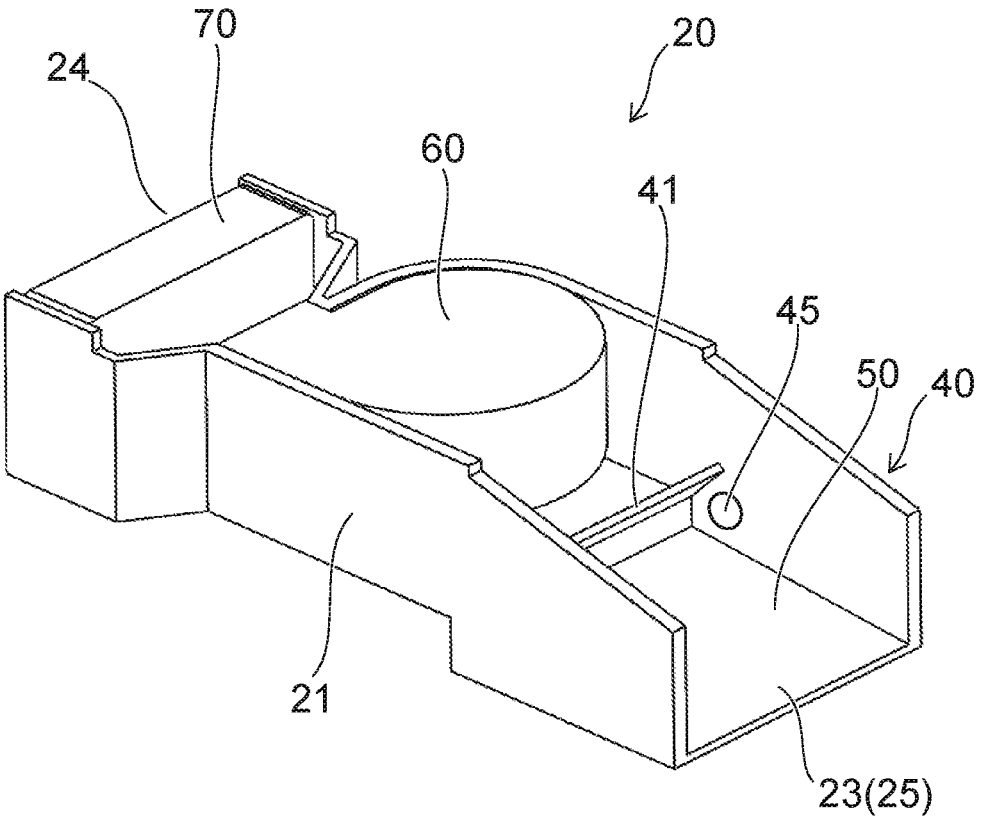
FIG. 4 is a perspective view of a state in which a cover is removed from the water deodorizing unit of FIG. 3.

FIG. 4 is a perspective view of a state in which a cover 22 is removed from the water deodorizing unit 20 of FIG. 3.

Figure 5:
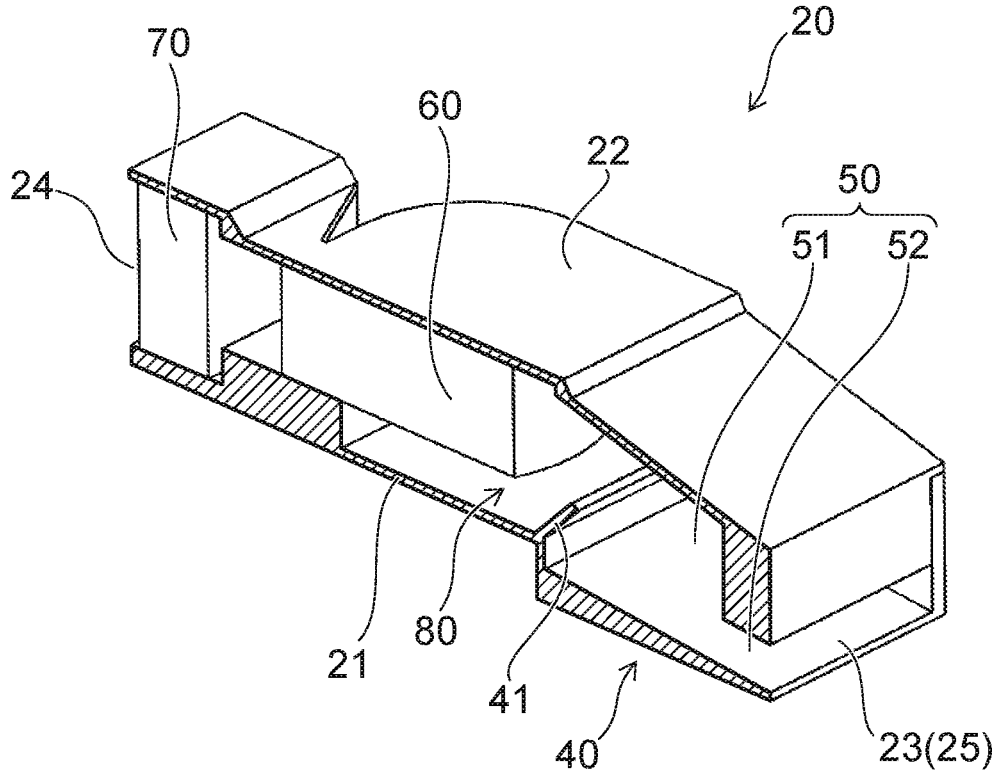
FIG. 5 is a cross-sectional perspective view of the water deodorizing unit of the toilet space deodorizing device according to one embodiment.

FIG. 5 is a cross-sectional perspective view of the water deodorizing unit 20.

As shown in FIG. 3 to FIG. 5, the water deodorizing unit 20 includes a case 21 and the cover 22. A water deodorizing part 40, a fan device 60, and an oxidation catalyst 70 are provided in the space between the case 21 and the cover 22.

Air is caused to flow through the space between the case 21 and the cover 22 by driving the fan device 60. An intake port part is provided at one end part of an air channel (a deodorizing air channel) 80 through which the air flows; and an exhaust port part is provided at the other end part of the deodorizing air channel 80. The intake port part forms an intake port 23; and the exhaust port part forms an exhaust port 24. The deodorizing air channel 80 links the intake port 23 and the exhaust port 24. The region of the deodorizing air channel 80 other than the intake port 23 and the exhaust port 24 is covered with the case 21 and the cover 22. The fan device 60 is a sirocco fan; for example, an axial fan or a cross-flow fan may be used.

The intake port 23 is positioned furthest upstream in the deodorizing air channel 80; and the exhaust port 24 is positioned furthest downstream in the deodorizing air channel 80. The fan device 60 is disposed downstream of the water deodorizing part 40 in the deodorizing air channel 80. The oxidation catalyst 70 is disposed downstream of the fan device 60 in the deodorizing air channel 80. The water deodorizing part 40, the fan device 60, and the oxidation catalyst 70 are arranged in order from the intake port 23 side between the intake port 23 and the exhaust port 24.

The water deodorizing part 40 includes a water collecting part 50. The water collecting part 50 includes a first space 51 and a second space 52. The first space 51 and the second space 52 communicate with each other; and the second space 52 is positioned further toward the intake port 23 than is the first space 51. The second space 52 is provided between the intake port 23 and the first space 51.

The intake port 23 is open toward the bowl part 101 in the state in which the water deodorizing unit 20 is mounted on the toilet 100 shown in FIG. 2.

Air is intaken through the intake port 23 into the first space 51 via the second space 52 by driving the fan device 60. The height of the downstream end of the second space 52 in the deodorizing air channel 80 is lower than the height of the upstream end of the first space 51 in the deodorizing air channel 80. Here, "height" refers to the height along the vertical direction between the inner surface of the case 21 and the inner surface of the cover 22. The second space 52 functions as a restricting part having a reduced air channel cross-sectional area compared to the first space 51. The first space 51 is an enlarged part having an enlarged air channel cross-sectional area compared to the second space 52.

As shown in FIG. 4, a water supply part 45 is provided in a part of the case 21 forming the sidewall of the water collecting part 50. For example, the water supply part 45 is provided at a position of the water collecting part 50 proximal to the downstream-most end of the deodorizing air channel 80. For example, water is supplied from a water supply source (a service water line) to the water supply part 45 and inflows toward the water collecting part 50 from a water supply port (not illustrated) formed in the water supply part 45; and the water collecting part 50 can collect the water. In the invention, the position where the water supply part 45 is provided is not limited to a position of the water collecting part 50 proximal to the downstream-most end of the deodorizing air channel 80; and it is sufficient for the water supply to the water collecting part 50 to be possible from the position.

The water that collected in the water collecting part 50 is drained through a drainage part. The drainage part forms a drainage port 25; in the embodiment, the intake port 23 also is used as the drainage port 25; the drainage port 25 is open toward the bowl part 101; and the water that is collected in the water collecting part 50 is drained into the bowl part 101 through the drainage port 25. The bottom surface of the water collecting part 50 forms a downward incline toward the drainage port 25.

A water-receiving barrier 41 is provided in the water collecting part 50 at the most end of the fan device 60 side. The water-receiving barrier 41 protrudes from the bottom surface of the water collecting part 50 into the deodorizing air channel 80 of the first space 51. In the deodorizing air channel 80, the upper end of the water-receiving barrier 41 is positioned upstream of the lower end of the water-receiving barrier 41. The upper end of the water-receiving barrier 41 is positioned higher than the upper surface of the second space 52; and the distance (the height) between the upper end of the water-receiving barrier 41 and the bottom surface of the water collecting part 50 is higher than the height of the second space 52. A space is formed between the cover 22 and the upper end of the water-receiving barrier 41 and permits the flow of air from the first space 51 toward the fan device 60.

An operation of the deodorizing device 10 according to the embodiment will now be described.

Figure 6:
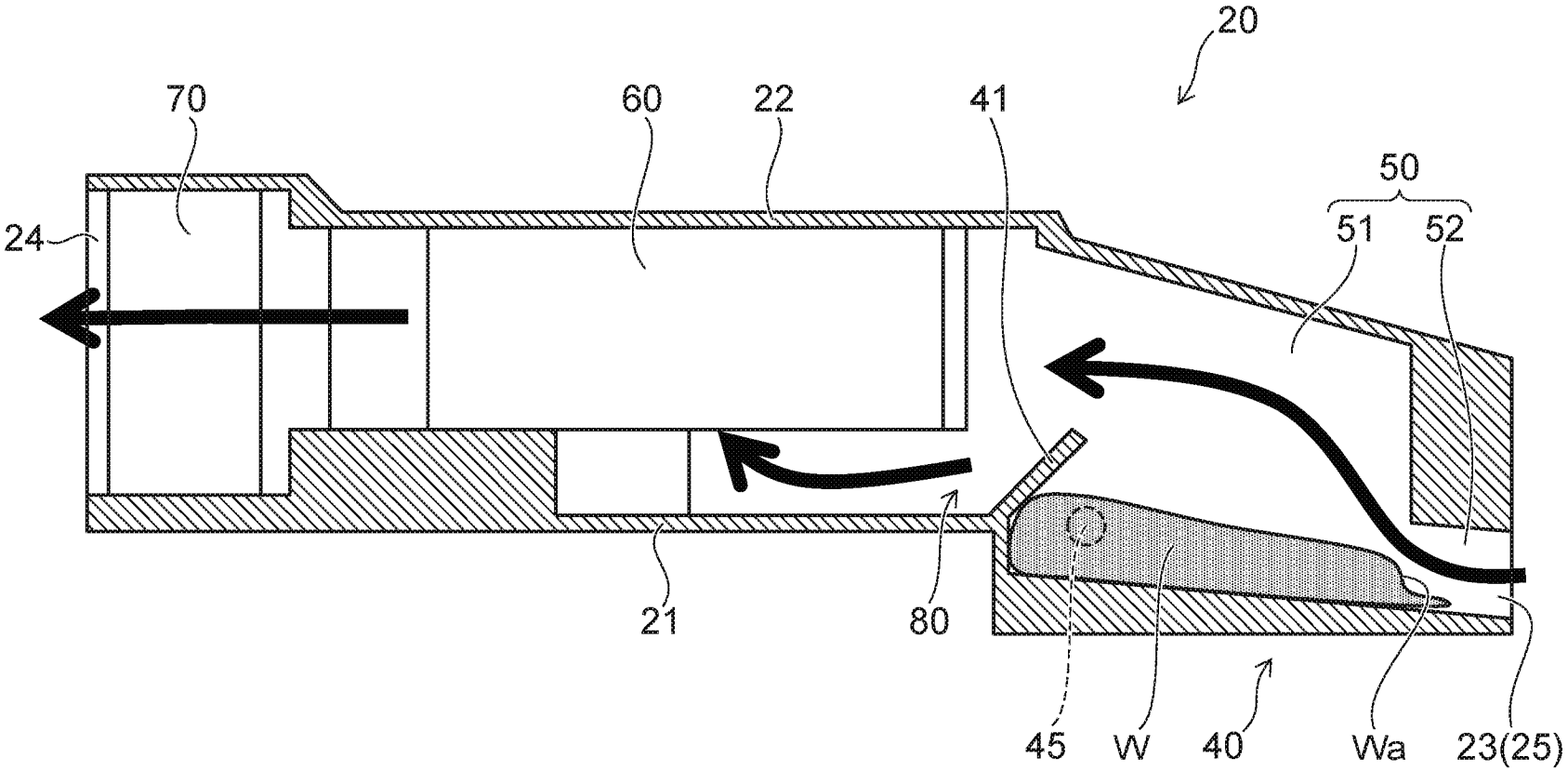
FIG. 6 is a cross-sectional view of a water collection operation in the toilet space deodorizing device according to one embodiment.

FIG. 6 is a cross-sectional view of the water collection operation in the deodorizing device 10.

Figure 7:
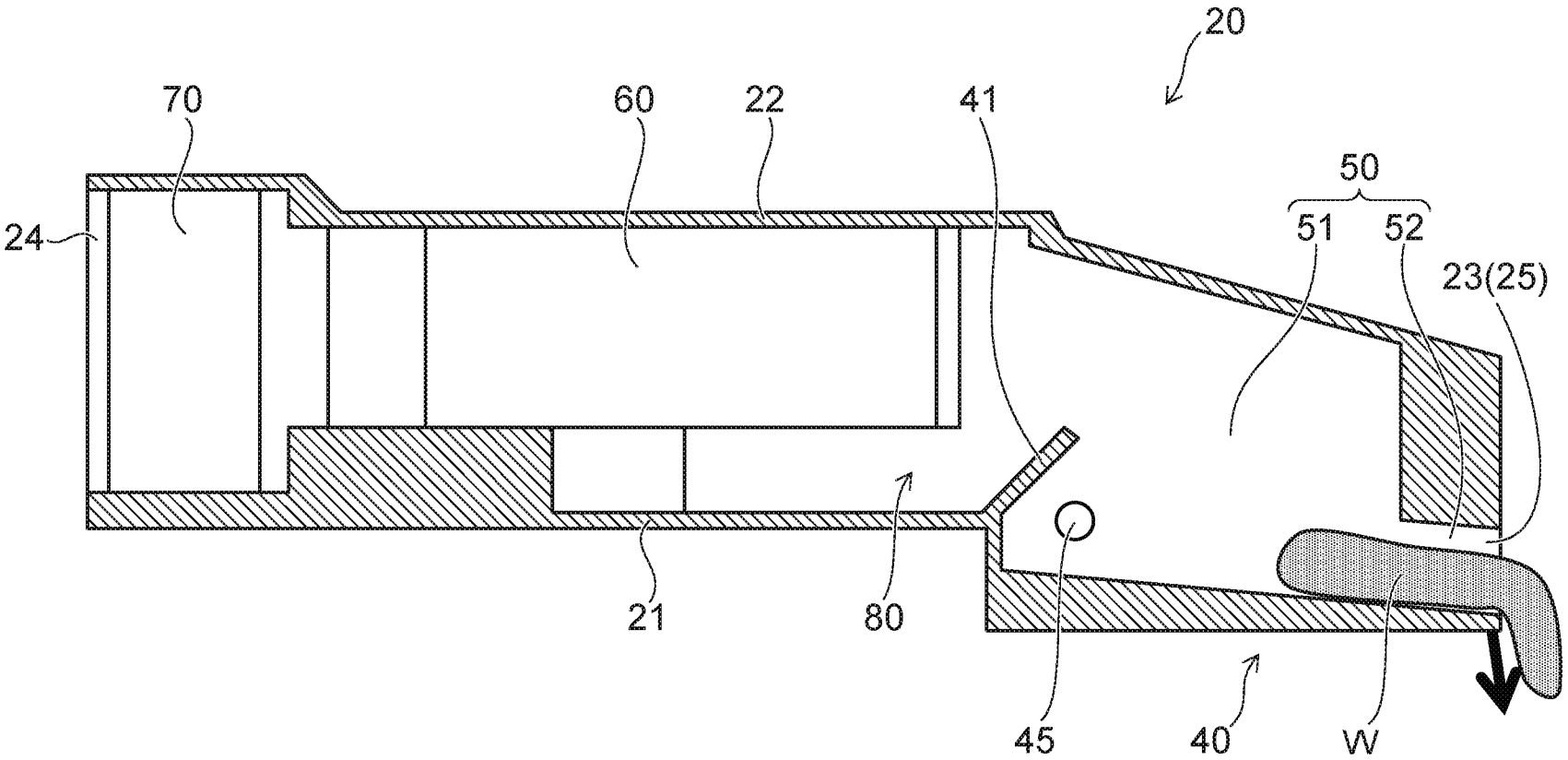
FIG. 7 is a cross-sectional view of a drainage operation of the toilet space deodorizing device according to one embodiment.

FIG. 7 is a cross-sectional view of the drainage operation of the deodorizing device 10.

When seat contact of the user on the toilet 100 is detected, the fan device 60 is driven by a control of the controller 30; and water is supplied from the water supply part 45 to the water collecting part 50 by a control of the controller 30. For example, the driving of the fan device 60 and the water supply from the water supply part 45 are started simultaneously. Or, there may be a time lag between the water supply timing and the timing of driving the fan device 60. The controller 30 controls the start and the stop of the driving of the fan device 60 and the start and the stop of the supply of the water from the water supply part 45. The seat contact of the user on the toilet 100 is detected by a sensor provided in the toilet space (e.g. in the toilet seat and/or the toilet 100). It is sufficient for the sensor to be able to detect the presence or absence of the user. For example, the sensor may detect the user's departure, the user's approach. The sensor is an infrared sensor; for example, a microwave sensor or a pressure sensor may be used. The driving of the fan device 60 and the water supply from the water supply part 45 may be started by the operation of the operation unit (e.g. a remote controller or a touch panel) by the user. The fan device 60 that is driven by the controller 30 intakes air through the intake port 23 into the deodorizing air channel 80. In FIG. 6, the flow of the air inside the deodorizing air channel 80 is illustrated by black thick arrows. The air that is intaken through the intake port 23 flows through the second space 52 and the first space 51 of the water collecting part 50 and is suctioned into the fan device 60; and the air that is discharged from the fan device 60 passes through the oxidation catalyst 70 and is exhausted from the exhaust port 24.

Air that is at atmospheric pressure is suctioned through the intake port 23 into the deodorizing air channel 80. In other words, the fan device 60 functions as a negative pressure generation device generating a negative pressure in the deodorizing air channel 80. The bottom surface of the water collecting part 50 forms a downward incline toward the drainage port 25 (also used as the intake port 23); therefore, the water that is supplied to the water collecting part 50 by the controller 30 can flow along the bottom surface of the water collecting part 50 toward the drainage port 25. A structure that might dam the flow of the water is not provided at the bottom surface of the water collecting part 50. Therefore, the water that is supplied to the water collecting part 50 by the controller 30 can be drained as-is through the drainage port 25.

However, in the state in which the fan device 60 is driven, the water that is supplied from the water supply part 45 can be collected in the water collecting part 50 because the negative pressure generated in the water collecting part 50 pushes, onto the water, air flowing in the reverse direction of the drainage direction of the water.

After a prescribed period of time, the supply of the water from the water supply part 45 is stopped by the controller 30. For example, the magnitude of the negative pressure generated in the water collecting part 50 can be controlled by the rotational speed control of the fan device 60. According to the magnitude of the negative pressure, the total amount of the water supplied from the water supply part 45 may be held in the water collecting part 50, or some of the water supplied from the water supply part 45 may be drained through the drainage port 25 and a remaining prescribed amount of the water may be held in the water collecting part 50. It is desirable for the total amount of the water supplied from the water supply part 45 to be held in the water collecting part 50; and because this configuration can hold more water in the water collecting part 50, the deodorizing performance can be ensured further. On the other hand, because the amount of the water held in the water collecting part 50 can be controlled according to the magnitude of the negative pressure, for example, by setting the water supplied from the water supply part 45 to be not less than the amount to be collected, the water amount to be collected can be held in the water collecting part 50 more reliably while draining some of the supplied water through the drainage port 25 even when the amount of the water supplied from the water supply part 45 fluctuates.

The air that includes offensive-odor components and is intaken through the intake port 23 flows along the surface of water W collected in the water collecting part 50; and the surface of the water W collected in the water collecting part 50 forms a part of the deodorizing air channel 80. Then, the highly water-soluble offensive-odor components such as ammonia, trimethylamine, etc., that cause a urine odor are deodorized by being dissolved in the water W collected in the water collecting part 50.

The offensive-odor components such as hydrogen sulfide, methylmercaptan, etc., that cause a feces odor, are not dissolved in the water W, and are in the air flowing further downstream through the deodorizing air channel 80 are deodorized by the oxidation catalyst 70. The oxidation catalyst 70 oxidizes and decomposes hydrogen sulfide and methylmercaptan.

Thus, according to the embodiment, ammonia and trimethylamine which are highly water-soluble can be deodorized by the water deodorizing part 40; and hydrogen sulfide and methylmercaptan which do not dissolve as easily in water as do ammonia and trimethylamine can be deodorized by the oxidation catalyst 70. The deodorized air is exhausted from the exhaust port 24.

Also, fine debris such as dust, paper bits, etc., suctioned through the intake port 23 with the air can be trapped by the water W collected in the water collecting part 50; and the performance decrease of the oxidation catalyst 70 due to the fine debris flowing into the oxidation catalyst 70 can be suppressed. The fine debris that undesirably reaches the fan device 60 also can be suppressed because the fan device 60 is disposed downstream of the water collecting part 50 in the deodorizing air channel. Normally, a mesh filter for trapping fine debris is provided at the intake port of the deodorizing device; however, in the embodiment, the fine debris can be trapped by the water collecting part 50; and a mesh filter may not be provided. Therefore, in the embodiment, the trouble of performing maintenance of the mesh filter can be eliminated.

By using a simple configuration in which one fan device 60 is used and the water deodorizing part 40 and the oxidation catalyst 70 are disposed inside one deodorizing air channel 80, both offensive-odor components having high water solubility and offensive-odor components having lower water solubility but higher oxidative decomposition capability can be deodorized effectively. Both the deodorizing performance and the avoidance of a larger size and a higher complexity can be realized.

The water collecting part 50 includes the second space 52 that functions as a restricting part, is lower than the first space 51, and has a small air channel cross-sectional area. The air that is intaken through the intake port 23 is accelerated by the second space 52. Thereby, the surface of the water W of the water collecting part 50 forming a part of the deodorizing air channel 80 undulates easily (waves form easily); and the contact surface area between the air and the water surface can be increased. The increase of the contact surface area between the air and the water surface increases the dissolution efficiency in water of the offensive-odor components having high water solubility in air. Therefore, for example, the degradation of the deodorizing performance can be avoided while avoiding the larger size and the higher complexity of a configuration that uses a water spraying device to spray water or guides water to stored water.

When the air is accelerated by the second space 52 (the restricting part), the pressure of the air pushing the water W increases; and the effect of holding the water W in the water collecting part 50 also increases.

An aromatic often is placed in the toilet space. Generally, the oxidation catalyst may generate an offensive odor when the alcohol component (e.g., ethanol or methanol) included in the aromatic or the like adheres. Although the alcohol component can be dissolved in the water in the water deodorizing part 40, water in which the alcohol component has dissolved may splash downstream; and the water in which the alcohol component has dissolved may contact the oxidation catalyst 70. Particularly when the water deodorizing unit 20 is provided in the sanitary washing device 200, downsizing is desirable; therefore, the distance between the water deodorizing part 40 and the oxidation catalyst 70 is likely to be short.

In the embodiment, the water-receiving barrier 41 is provided as a splash suppression device suppressing the splashing toward the oxidation catalyst 70 of the water W collected in the water collecting part 50. According to such an embodiment, the water in which the alcohol component has dissolved can avoid contacting the oxidation catalyst 70 because the adhesion to the oxidation catalyst 70 of the alcohol component dissolved in the water W of the water collecting part 50 is avoided effectively; and the water-receiving barrier 41 suppresses the splashing toward the oxidation catalyst 70 of the water in which the alcohol component has dissolved.

According to the embodiment, alcohol dissolution is possible merely by storing the water W in the water collecting part 50; therefore, the configuration is simple compared to, for example, mist spraying from a nozzle, etc. The water-receiving barrier 41 also has a simple configuration; therefore, according to the embodiment, the offensive odor generation by the oxidation catalyst 70 caused by alcohol components can be avoided while avoiding a larger size and a higher complexity.

The first space 51 of the water collecting part 50 is higher than the second space 52 and has a larger volume, and is provided as an enlarged part having an enlarged air channel cross-sectional area. Such a first space 51 also can function as the splash suppression device recited above. In other words, by enlarging the air channel cross-sectional area at the first space 51, the air velocity of the air can be reduced; and the splashing of the water W downstream can be suppressed thereby. The splashing of the water toward the fan device 60 also can be suppressed; and the malfunction and the performance decrease of the fan device 60 can be avoided.

An example is shown in FIG. 6 in which the water W collects in a region extending from the water-receiving barrier 41 through the first space 51 to the second space 52. It is sufficient for the water W to collect in at least a partial region of the first space 51; and it is unnecessary for the water W to collect in the second space 52. If the water W collects in the second space 52 as well, the contact surface area between the air and the water surface can be increased, which increases the dissolution efficiency in water of the offensive-odor components having high water solubility in air.

The water W that is pushed by the air is dammed by the water-receiving barrier 41 and impeded from receding downstream in the deodorizing air channel 80. In this state, a water surface Wa that has a wall-like shape forms easily and opposes the air inflowing through the intake port 23 and flowing along the upper surface of the second space 52. The wall-like shape water surface Wa forms a boundary around which the water surface upstream of the water surface Wa in the deodorizing air channel 80 is formed at a position lower than the water surface downstream in the deodorizing air channel 80. A level difference forms between the water surface upstream of the water surface Wa and the water surface downstream of the water surface Wa. Because the air contacts the wall-like shape water surface Wa in addition to the upper surface of the water W, the dissolution efficiency in water of the highly water-soluble offensive-odor components can be increased; and the fine debris is trapped by the water W even more easily.

Because the water-receiving barrier 41 extends higher than the upper surface of the second space 52 at the intake port 23 side, the height inside the first space 51 of the water W dammed by the water-receiving barrier 41 easily becomes higher than the height inside the second space 52 of the water W dammed by the water-receiving barrier 41. This easily forms the level difference of the water surface at the vicinity of the boundary between the first space 51 and the second space 52; and the wall-like shape water surface Wa forms easily.

The user rises from the toilet 100; and the controller 30 stops the driving of the fan device 60 based on the user rising from the toilet 100. When the fan device 60 is stopped, the water collecting part 50 returns to atmospheric pressure; and the force that holds the water W in the collected state is released. Then, because the bottom surface of the water collecting part 50 has the downward incline toward the drainage port 25, the water W that collected in the water collecting part 50 is drained into the bowl part 101 of the toilet 100 (shown in FIGS. 1 and 2) through the drainage port 25 as shown in FIG. 7. The sensor that is provided in the toilet space detects the user rising from the toilet 100. The driving of the fan device 60 may be stopped by the operation of the operation unit (e.g. a remote controller or a touch panel) by the user. The driving of the fan device 60 may be automatically stopped after a predetermined period of the starting of the driving of the fan device 60 by the operation of the operation unit.

If a movable member, e.g., a solenoid valve is used as the drainage mechanism, the water may not be drained due to a valve-opening failure caused by sticking of the solenoid valve; but in the embodiment, water drainage is possible merely by stopping the formation of the negative pressure by the fan device 60 without providing such a drainage mechanism. A simple configuration can drain the water from the water collecting part 50 and reduce the water remaining in the water collecting part 50; and the formation of the biofilm caused by the remaining water can be suppressed. The fine debris that is trapped by the water W collected in the water collecting part 50, etc., also is drained with the water W.

The collection and the drainage of the water can be realized by using, as the device forming the negative pressure, the fan device that is originally necessary in the deodorizing device to intake and exhaust the air as a minimum electrical component; it is unnecessary to provide separately a pump or the like for forming the negative pressure; and a lower cost and downsizing are possible.

Because the water collecting part 50 bottom surface has a downward incline, the water is drained easily from the water collecting part 50; the water that remains in the water collecting part 50 can be reduced further; and the effect of suppressing the formation of the biofilm can be increased.

According to the embodiment described above, by the formation of the negative pressure accompanying the flow of the air, the water W collects in the water collecting part 50; the surface of the water W forms a part of the deodorizing air channel 80; and the air that includes offensive-odor components flows along the surface of the water W. Such a configuration can cause a higher amount of air to contact the water surface compared to, for example, a configuration in which the water does not collect due to the formation of a negative pressure but the air is caused to contact the surface of water prestored in a tank; and the dissolution efficiency of the offensive-odor components in water can be increased. Accordingly, the embodiment realizes both the deodorizing performance and the avoidance of a larger size and a higher complexity.

For example, the oxidation catalyst 70 has a cartridge form, is attachable and detachable, and is replaceable in the sanitary washing device 200. As shown in FIG. 2, the user can replace the oxidation catalyst 70 easily because the oxidation catalyst 70 is disposed at the outer edge part side of a casing 202 of the sanitary washing device 200.

For example, the oxidation catalyst 70 has a honeycomb structure and has the effect of suppressing the operation sound of the fan device 60. The arrangement relationship between the oxidation catalyst 70 and the fan device 60 described above reduces the noise when deodorizing compared to a configuration in which the fan device 60 is disposed further toward the outer edge part of the casing 202 than is the oxidation catalyst 70.

Although an example is described in the embodiments described above in which the deodorizing device 10 is provided in the sanitary washing device 200, it is sufficient for the deodorizing device according to the invention to be provided in a toilet space including at least one of a flush toilet or a urinal; for example, the deodorizing device 10 may be provided in a urinal.

Although an example is described in the embodiments described above in which a fan device is employed as the negative pressure generation device, the invention is not limited to forming the negative pressure by the air suction of the fan device; and it is sufficient for the negative pressure generation device to be able to form a negative pressure in the water collecting part. For example, a pump may be employed as the negative pressure generation device; and a negative pressure may be formed by the air suction of the pump.

Although an example is described in the embodiments described above in which the intake port also is used as the drainage port, the invention is not limited to a configuration in which the intake port 23 also is used as the drainage port 25; and the intake port 23 and the drainage port 25 may be provided as separate components.

Although an example is described in the embodiments described above in which the drainage port is open toward the bowl part, the drainage port 25 may not be open toward the bowl part 101 in the invention. For example, a configuration may be used in which the water of the water collecting part 50 is drained through a drainage port opening inside the water collected in the bowl part 101; or a configuration may be used in which the water of the water collecting part 50 is drained through a drainage port into a drainage pipe in which the drainage water of the toilet device 1 flows.

Among toilet space deodorizing devices, downsizing of a deodorizing device provided in the sanitary washing device 200 is particularly desirable; and a higher complexity and a larger size of the deodorizing device can be suppressed more for the configuration in which the drainage port 25 is open toward the bowl part 101 than for a configuration in which the water is drained inside the water collected in the bowl part 101 or a configuration in which the water is drained into a drainage pipe.

By setting the distance (the length in the vertical direction) between the upper surface and the lower surface of the second space 52 to be less than the distance (the length in the vertical direction) between the upper surface and the lower surface of the first space 51, the air channel cross-sectional area of the second space 52 can be less than the air channel cross-sectional area of the first space 51; and the second space 52 can function as the restricting part described above.

In the example shown in FIG. 6, the length in the vertical direction of the second space 52 is set to be less than the length in the vertical direction of the first space 51 by providing a level difference between the upper surface of the second space 52 and the upper surface of the first space 51.

Or, the length in the vertical direction of the second space 52 can be set to be less than the length in the vertical direction of the first space 51 by providing a level difference between the lower surface of the second space 52 and the lower surface of the first space 51.

Or, the air channel cross-sectional area of the second space 52 can be set to be less than the air channel cross-sectional area of the first space 51 by setting the inter-side surface distance (the length in the horizontal direction) of the second space 52 to be smaller than the inter-side surface distance (the length in the horizontal direction) of the first space 51.

Hereinabove, the embodiments of the invention are described with reference to specific examples. However, the invention is not limited to such specific examples; and various modifications based on the technical spirit of the invention are possible.

What is claimed is:

1. A toilet space deodorizing device, comprising:

an intake port part forming an intake port;

an exhaust port part forming an exhaust port;

a fan device intaking air through the intake port;

a water collecting part provided inside a deodorizing air channel, the deodorizing air channel linking the intake port and the exhaust port and allowing the air to flow, the water collecting part being configured to collect water inside the deodorizing air channel;

a water supply part supplying water to the water collecting part;

a drainage part forming a drainage port draining water from the water collecting part;

a negative pressure generation device forming a negative pressure in the water collecting part; and a controller controlling a driving of the negative pressure generation device, the controller driving the negative pressure generation device to generate a negative pressure, and the water supplied from the water supply part being collected on a bottom surface of the water collecting part due to air flowing into the water collecting part and pressing on the water supplied from the water supply part by the negative pressure.

2. The toilet space deodorizing device according to claim 1, wherein the water collected in the water collecting part is drained through the drainage port by stopping the negative pressure generation device.

3. The toilet space deodorizing device according to claim 2, wherein the negative pressure generation device is the fan device.

4. The toilet space deodorizing device according to claim 1, wherein a bottom surface of the water collecting part forms a downward incline toward the drainage port.

5. The toilet space deodorizing device according to claim 1, wherein a water surface of the water collected in the water collecting part forms a part of the deodorizing air channel, and the water collecting part includes a protruding part protruding from an interior wall surface of the water collecting part at the intake port side of the water collecting part to make a cross-sectional area of the deodorizing air channel narrow.

6. The toilet space deodorizing device according to claim 5, wherein the water collecting part forms a first space and a second space, the second space communicating with the first space and being positioned further toward the intake port than is the first space, and the protruding part protrudes downward from an upper surface of the water collecting part and forms an interior wall surface of the second space.

7. The toilet space deodorizing device according to claim 6, wherein a water surface having a wall-like shape is formed in the water collected in the water collecting part, the water surface opposing air inflowing through the intake port and flowing along a bottom surface of the water collecting part.

8. The toilet space deodorizing device according to claim 7, further comprising a water-receiving barrier protruding into the deodorizing air channel from the bottom surface of the water collecting part, an upper end of the water-receiving barrier being positioned higher than an upper surface of the second space.

9. The toilet space deodorizing device according to claim 8, wherein the water collects in a region extending from the water-receiving barrier through the first space to the second space.

10. A sanitary washing device, comprising the toilet space deodorizing device according to claim 1, the sanitary washing device being provided at a toilet including a bowl part, the drainage port being open toward the bowl part, water draining through the drainage port into the bowl part.

11. The sanitary washing device according to claim 10, wherein the drainage port is the intake port.

12. The toilet space deodorizing device according to claim 1, wherein the controller drives the negative pressure generation device to generate the negative pressure and forms a water surface of the water on the bottom surface of the water collecting part due to the air pressing on the water by the negative pressure.

13. The toilet space deodorizing device according to claim 1, wherein the controller drives the negative pressure generation device to generate the negative pressure and collects the water in clumps on the bottom surface of the water collecting part due to the air pressing on the water by the negative pressure.

14. The toilet space deodorizing device according to claim 1, further comprising a water-receiving barrier protruding into the deodorizing air channel from the bottom surface of the water collecting part.

* * * * *